US005563477A

United States Patent [19]

Ribarich et al.

[11] Patent Number: 5,563,477

[45] Date of Patent: Oct. 8, 1996

[54] METHOD FOR OPERATING A BALLAST FOR DISCHARGE LAMPS

[75] Inventors: Thomas Ribarich, Glarus; Felix Tobler, Schanis, both of Switzerland

[73] Assignee: Knobel AG Lichttechnische Komponenten, Ennenda, Switzerland

[21] Appl. No.: 420,880

[22] Filed: Apr. 13, 1995

[30] Foreign Application Priority Data

Apr. 15, 1994 [EP] European Pat. Off. ..... 94105852
Mar. 31, 1995 [EP] European Pat. Off. ..... 95104776

[51] Int. Cl.[6] ..... G05F 1/00

[52] U.S. Cl. ..... 315/307; 315/291; 315/308; 315/DIG. 5; 315/DIG. 7

[58] Field of Search ..... 315/291, 307, 315/308, 209 R, 310, 311, DIG. 5, DIG. 7

[56] References Cited

U.S. PATENT DOCUMENTS

| | | | |
|---|---|---|---|
| 4,277,728 | 7/1981 | Stevens | 315/307 |
| 4,723,098 | 2/1988 | Grubbs . | |
| 4,873,471 | 10/1989 | Dean et al. . | |
| 5,049,790 | 9/1991 | Herfurth et al. . | |
| 5,138,234 | 8/1992 | Moisin . | |
| 5,148,087 | 9/1992 | Moisin et al. . | |

FOREIGN PATENT DOCUMENTS

| | | |
|---|---|---|
| 0178852 | 4/1986 | European Pat. Off. . |
| 0239420 | 9/1987 | European Pat. Off. . |
| 0338109 | 10/1989 | European Pat. Off. . |
| 0359860 | 3/1990 | European Pat. Off. . |
| 0059064 | 9/1992 | European Pat. Off. . |
| 3140175 | 4/1983 | Germany . |
| 3432266 | 3/1985 | Germany . |
| 92/22184 | 12/1992 | WIPO . |

OTHER PUBLICATIONS

European Search Report of Jul. 17, 1995.

*Primary Examiner*—Frank Gonzalez
*Assistant Examiner*—Reginald A. Ratliff
*Attorney, Agent, or Firm*—Greenblum & Bernstein P.L.C.

[57] ABSTRACT

Method for operating a ballast for discharge lamps. The ballast comprises a rectifier for rectifying and filtering an AC line voltage, with the rectified voltage being smoothed with a capacitor and fed to an inverter, wherein the inverter drives a resonant lamp circuit that includes a gas discharge lamp, with the frequency of the inverter being generated by a voltage controlled oscillator and a control circuit, so that during normal operation of the lamp, the inverter frequency is chosen according to the current value of the rectified voltage, and during start-up of the ballast, the inverter frequency is lowered from a high starting frequency, while being continuously monitored to ensure the latter does not fall below a minimum frequency, with the value of the minimum frequency depending on the value of the rectified voltage, thus decreasing the dependence of the light flux on the rectified voltage and assuring a safe start-up process.

15 Claims, 3 Drawing Sheets

METHOD FOR OPERATING A BALLAST FOR DISCHARGE LAMPS

CROSS REFERENCE TO RELATED APPLICATIONS

This application claims the priority of European Application No. EP 94 105 852.1, filed Apr. 15, 1994, and of European Application No. EP (not yet known), filed Mar. 31, 1995, the disclosures of which are incorporated herein by reference in their entireties.

BACKGROUND OF THE INVENTION

1. Field of the Invention

The present invention relates to a method for operating a ballast for gas discharge lamps, wherein the ballast comprises a line-voltage rectifier generating a rectified voltage, an inverter fed by the rectified voltage and generating an AC voltage with an inverter frequency, in combination with a lamp in a lamp circuit driven by the AC voltage.

2. Discussion of the Background of the Invention and Material Information

Ballasts of the previously-noted type, for gas discharge lamps, feed a rectified line voltage to an inverter, which converts the rectified voltage back to an AC voltage. This AC voltage is used to operate one or more lamps in a resonant lamp circuit. The frequency of the AC voltage, i.e. the inverter frequency, usually lies close to the resonance frequency of the lamp circuit.

It has been determined that the lamp power of such devices depends strongly on the value of the rectified voltage. Therefore, it has previously been important to smooth the rectified voltage in order to reduce the residual ripple. This in turn requires the use of expensive components, usually comprising large coils and capacitors.

Even if the rectified voltage is smoothed carefully, lamp power still depends on the constancy of the effective line voltage.

Prior art European Patent Publications EP 178 852, EP 239 420 and EP 338 109 describe ballasts that regulate the inverter frequency to keep the lamp current constant or the lamp power constant. This allows regulation of the light flux generated by the lamp. The corresponding regulators are, however, comparatively expensive.

SUMMARY OF THE INVENTION

Hence, it is a general object of the invention to provide a method for operating a ballast, as previously described that avoids at least part of the noted disadvantages.

Now, in order to implement these and still further objects of the invention, which will become more readily apparent as the description proceeds, a method for operating a ballast for discharge lamps, wherein the ballast comprises a line-voltage rectifier for generating a rectified voltage and an inverter fed by the rectified voltage for generating an AC voltage with an inverter frequency, in combination with a lamp in a lamp circuit driven by the AC voltage, wherein the method, during normal operation, with said lamp burning, comprises choosing the inverter frequency as a function of the rectified voltage.

A further embodiment of the method of this invention further includes, in a normal voltage range of the rectified voltage, linearly decreasing the inverter frequency with decreasing rectified voltage.

Another embodiment of the method of this invention further includes, in a low voltage range below the normal voltage range, linearly increasing the inverter frequency with decreasing rectified voltage.

In a differing embodiment of the method of this invention, the derivative of the inverter frequency, with respect to the rectified voltage, fulfills:

$$(df_W/dU_{ZK})|_u = 31\ k(df_W/dU_{ZK})|_n$$

wherein $(df_W/dU_{ZK})|_u$ is the derivative of the inverter frequency $f_W$ in respect to the AC voltage $U_{ZK}$ in the low voltage range, wherein $(df_W/dU_{ZK})|_n$ is the derivative of the inverter frequency $f_W$ with respect to the AC voltage $U_{ZK}$ in the normal voltage range, and k is a constant between 2 and 2.5.

A yet further embodiment of the method of this invention further includes, during a start-up phase for causing the lamp to strike, varying the inverter frequency but preventing the inverter frequency from falling below a minimum frequency, and choosing the minimum frequency as a function of the rectified voltage.

A yet another embodiment of the method of this invention, further includes, in a normal voltage range of the rectified voltage, decreasing the minimum frequency with the rectified voltage decreasing, and in a low voltage range of the rectified voltage, increasing the minimum frequency with the rectified voltage decreasing.

A yet differing embodiment of the method of this invention further includes, keeping the minimum voltage, as a function of the rectified voltage during the start-up phase, substantially equal to the inverter frequency as a function of the rectified voltage during the normal operation of the lamp.

Another embodiment of the method of this invention further includes, during at least part of the start-up phase, choosing the inverter frequency as a function of a current in the lamp circuit while the inverter frequency is above the minimum frequency.

Still another embodiment of the method of this invention further includes, during the start-up phase, bringing the inverter frequency, in a first step upon switching-on of the ballast, to a first frequency range;

bringing the inverter frequency, in a second step for pre-heating the lamp, to a second frequency range;

bringing the inverter frequency, in a third step for striking the lamp, to a third frequency range; and bringing the lamp frequency, after the striking of the lamp, into a normal range, with the first frequency range being higher than the second and third frequency ranges and higher than the normal frequency range.

A still differing embodiment of the method of this invention further includes, in the second step, determining a current in the lamp circuit and regulating the inverter frequency to make the current equal to a given lamp heating current.

Yet a further embodiment of the method of this invention further includes, in the third step, determining a current in the lamp circuit and regulating the inverter frequency to make the current equal to a given ignition current.

A yet still further embodiment of the method of this invention further includes, in the third step, regulating the inverter frequency to make the current equal to a given ignition current, with the ignition current being larger than the heating current.

A yet still differing embodiment of the method of this invention further includes, in the first step, continuously decreasing the inverter frequency in time.

A yet alternate embodiment of the method of this invention further includes, producing a ripple in the rectified voltage via the line voltage and frequency-modulating the inverter frequency via the ripple.

In a further variation of the previous embodiment of the method of this invention, the amplitude of said ripple is at least 10% of the rectified voltage.

By choosing the inverter frequency as a function of the rectified voltage, the dependence of the lamp power on the rectified voltage can be reduced. Since the inverter frequency can therefore be derived directly from the rectified voltage, no complicated regulator with a corresponding feed-back loop is required.

A further advantage of this method lies in the fact that a ripple in the rectified voltage is compensated automatically. Since the inverter frequency is a function of the rectified voltage, it is frequency modulated as it follows the variations of the rectified voltage. This broadens the electromagnetic noise spectrum of the ballast which, in time averaging, reduces the peaks observed in the noise spectrum and allows a reduction of the components required for noise filtering. In order to generate a sufficiently high frequency modulation of the inverter frequency, the amplitude of the ripple of the rectified voltage is preferably at least 10%, more preferably 10%–20%, of the average value of the rectified voltage.

If the lamp circuit is substantially an inductive load, when being operated with the burning lamp in normal operation within a normal range of the rectified voltage, the inverter frequency should decrease linearly with decreasing rectified voltage to produce a linear order correction of the lamp power. Such a correction is sufficient for suppressing undesired modulations of the light flux and its implementation does not require complicated circuitry. In a low voltage range of the rectified voltage below the normal range, the inverter frequency should not be decreased further. Preferably, it should be increased again linearly, this avoiding a flickering of the lamps at low line voltages. Furthermore, it reduces the switching load of the inverter which otherwise would increase, at low frequencies and low rectified voltages, due to the nonlinear properties of the lamp circuit.

During start-up for causing a lamp to strike or light, the inverter frequency should preferably be prevented from falling below a minimum inverter frequency. The minimum inverter frequency in turn should be chosen as a function of the rectified voltage, thus preventing excessively high currents in the lamp circuit.

The initial inverter frequency during start up should preferably be higher than the inverter frequency during heating or ignition of the lamp, this avoiding initial current peaks when switching on the ballast.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
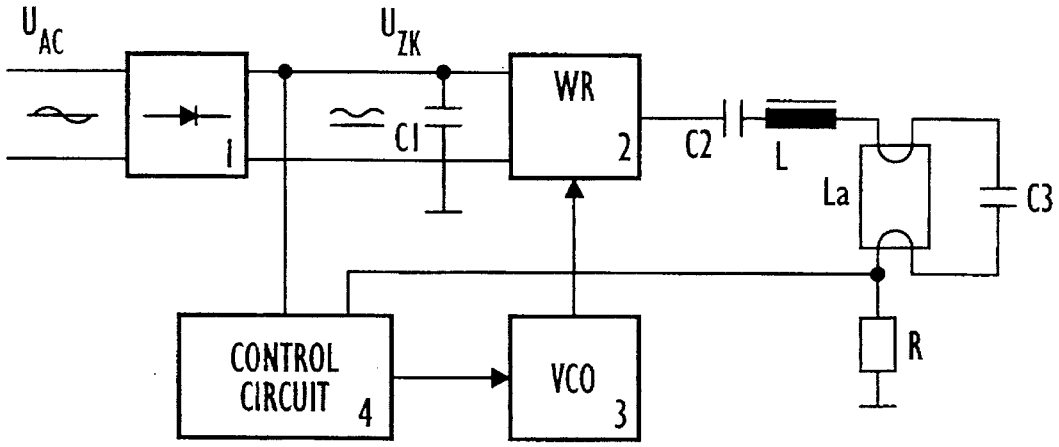
FIG. 1 is a simplified block circuit diagram of a ballast circuit.

The basic set-up of a ballast, operated according to the present invention, is shown in the simplified block diagram of FIG. 1. The ballast is designed for operation on an AC line. The line voltage $U_{AC}$ is first rectified in a rectifier 1, which is comprised of a substantially conventional rectifier and can e. g. be a full wave rectifier bridge comprising filters and, optionally, a current limiter. The rectified voltage $U_{ZK}$ from rectifier 1 is smoothed over a capacitor C1 of e.g. 10 μF.

An inverter 2 is provided for converting the rectified voltage $U_{ZK}$ into a high frequency AC voltage and feeding it to a lamp circuit. The lamp circuit is a conventional resonant circuit with the series capacitor C2, inductance L, gas discharge lamp La, parallel capacitor C3 and resistor R. Other designs of the lamp circuit with one or more lamps are known to a person skilled in this art.

The inverter frequency $f_W$ is generated by a voltage controlled oscillator (VCO) 3. The frequency of this oscillator is controlled by a control circuit 4, with control circuit 4 comprising, on the one hand, components for controlling the inverter frequency during pre-heating and striking of the lamp. On the other hand, it contains a circuit that selects the inverter frequency $f_W$ during normal operation of the burning lamp as a function of the rectified voltage $U_{ZK}$. The operation of this latter circuit will now be described in more detail.

Figure 2:
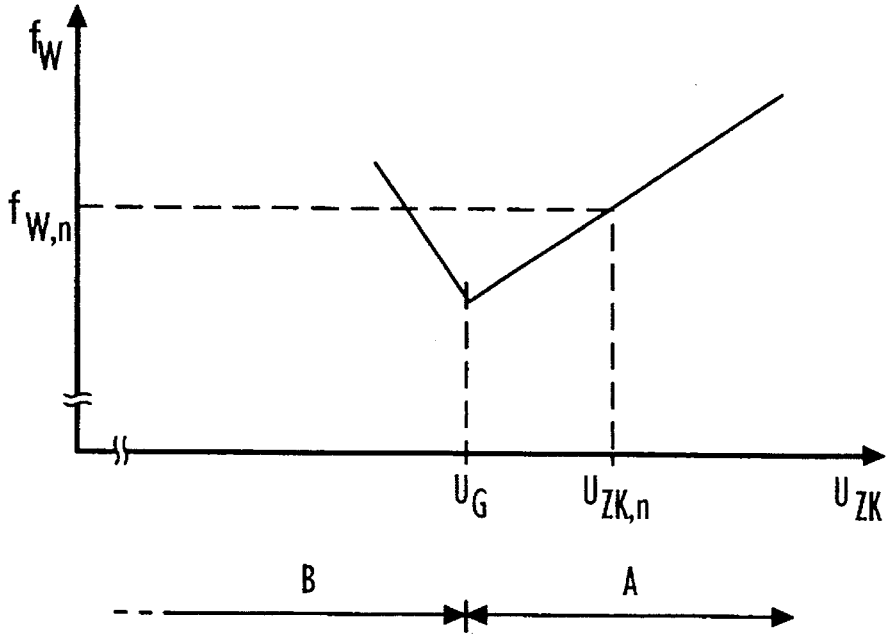
FIG. 2 illustrates the inverter frequency $f_W$ as a function of the rectified voltage $U_{ZK}$.

During normal operation of lamp La (i. e. after successful ignition), the inverter frequency $f_W$ is given by a function as shown in the diagram of FIG. 2. Therein, $U_{ZK,n}$ denotes the normal average rectified voltage $U_{ZK}$ and $f_{W,n}$ denotes the normal average inverter frequency at this voltage. Control circuit 4 and voltage controlled oscillator VCO 3 are designed such that the normal average inverter frequency $f_{W,n}$ lies close to the resonance frequency of the lamp circuit.

In a normal voltage range A of the rectified voltage $U_{ZK}$ the inverter frequency $f_W$ is controlled such that it decreases linearly with decreasing rectified voltage $U_{ZK}$. Since the lamp circuit with burning lamp La presents a substantially inductive load, a decrease of $f_W$ at a given $U_{ZK}$ causes a corresponding increase of the lamp current. When $U_{ZK}$ decreases, the lamp power can therefore be kept constant by increasing the inverter frequency $f_W$.

In the present embodiment of the invention, a linear dependence between the inverter frequency $f_W$ and the rectified voltage $U_{ZK}$ is utilized. The derivative $df_W/dU_{ZK}$ of the inverter frequency, with respect to the rectified voltage, is chosen such that the lamp current and lamp voltage, respectively, are in linear approximation independent of the rectified voltage $U_{ZK}$.

Since the rectified voltage $U_{ZK}$ shows a certain residual ripple originating from the AC line voltage, the inverter frequency $f_W$ is frequency modulated. This broadens the time-average noise spectrum generated by the ballast circuit and reduces individual noise peaks. A sufficiently high frequency modulation of $f_W$ is reached if the amplitude $U_{RW}$ of the residual ripple of the rectified voltage $U_{ZK}$ is at least 10%, preferably 10%–20%, of the rectified voltage $U_{ZK}$.

In a low voltage range B of the rectified voltage $U_{ZK}$ below a threshold voltage $U_G$, the inverter frequency $f_W$ again increases. In the present embodiment, the threshold voltage $U_G$ is about 80% of the normal average rectified voltage $U_{ZK,n}$. The increase of the inverter frequency $f_W$ at low rectified voltage $U_{ZK}$ has the following two advantages:

Because of the non-linear properties of the lamp circuit, the phase shift between current and voltage at the output of inverter 2, depends on the rectified voltage $U_{ZK}$. If the rectified voltage is low, the phase shift increases the switching load of the inverter, which is however avoided by increasing the inverter frequency $f_W$. On the other hand, increasing the inverter frequency reduces the current drawn from the rectifier which leads to an increase of the rectified voltage $U_{ZK}$. This reduces the ripple of $U_{ZK}$ and increases the minimum voltage available for lamp La. In this way, a flickering of lamp La can be avoided down to a very low line voltage or rectified voltage, respectively.

In the low voltage range B, the slope of the curve for the inverter current is negative, i.e. the derivative $df_W/dU_{ZK}$ is smaller than zero. Preferably, its absolute value is chosen to be approximately twice as large as in the normal voltage range A. In other words, if $(df_W/dU_{ZK})|_n$ denotes the derivative in the normal voltage range A and $(df_W/dU_{ZK})|_u$ denotes the derivative in the low voltage range B, there results $$(df_W/dU_{ZK})|_u=-k(df_W/dU_{ZK})|_n,$$

wherein k ranges from 2.0 to 2.5.

Figure 3:
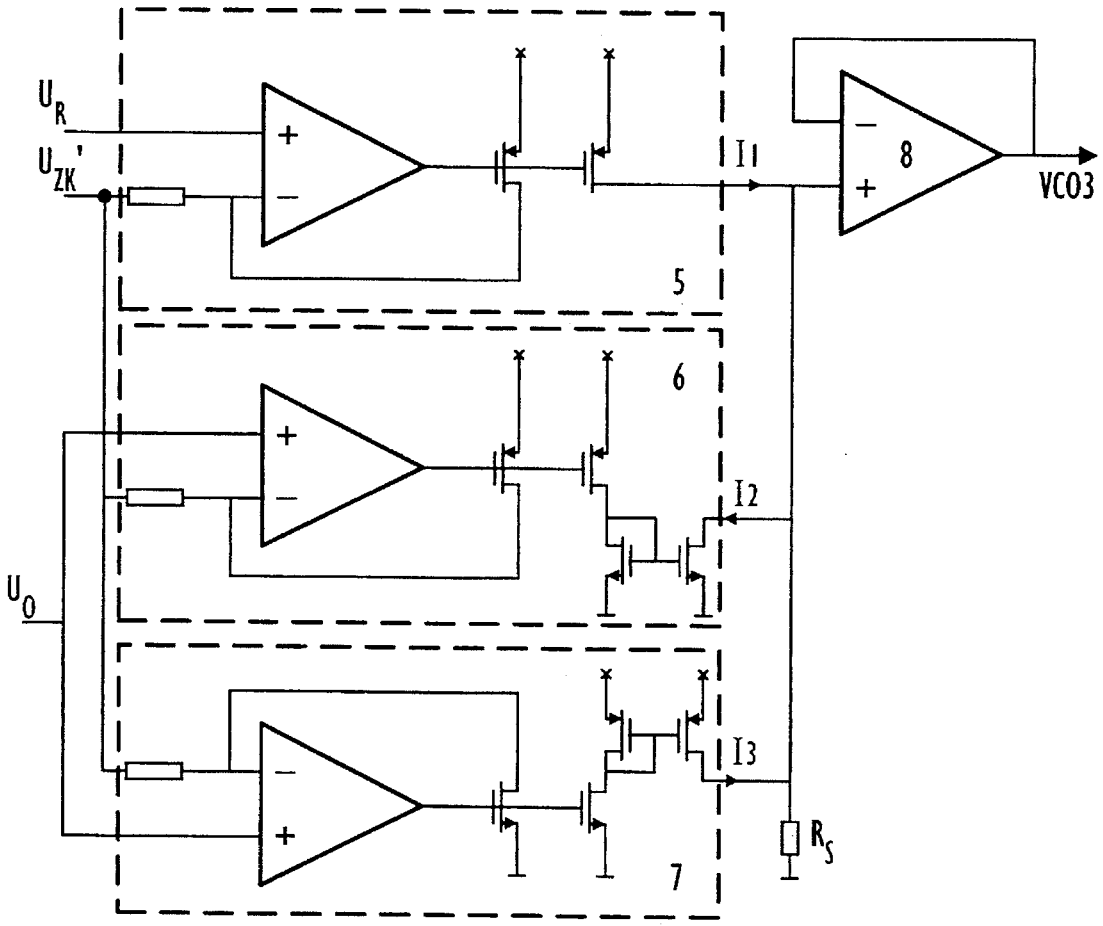
FIG. 3 is a detail of the control circuit of the ballast.

FIG. 3 shows a detail of control circuit 4, with this part of the control circuit generating a control voltage for voltage controlled oscillator VCO 3 when the lamp is burning.

A reference voltage $U_R$ and a voltage $U_{ZK}$, proportional to the rectified voltage $U_{ZK}$, are fed to a first amplifier stage 5. This first amplifier stage 5 generates a current I1 which is 0 for $U_{ZK}>U_R$ and proportional to $U_{ZK}-U_R$ for $U_{ZK}<U_R$.

Voltage $U_{ZK}$ and a second reference voltage $U_0$ are fed to a second and a third amplifier stage 6, 7, respectively. These two stages generate the currents I2 and I3, respectively, wherein I2+I3 is proportional to $U_{ZK}-U_0$. I2 is always negative or 0, I3 is always positive or 0.

The currents I1, I2, I3 are converted into a voltage over resistor $R_S$ and are fed to voltage controlled oscillator VCO 3 via a buffer 8.

Via suitable design of the components of this circuit, it is therefore possible to generate a voltage proportional to $U_{ZK}$ (plus a constant voltage adjustable via $U_0$). This is the control voltage for voltage controlled oscillator VCO 3 in the normal voltage range A (cf. FIG. 2).

The transition $U_G$ to the low voltage range B can by adjusted by means of reference voltage $U_R$. In the low voltage range B, a voltage generated by stage 5 is added to the voltage generated by stages 6 and 7, wherein the voltage generated by stage 5 increases when the rectified voltage $U_{ZK}$ decreases. In this way it becomes possible to generate the control voltage for a frequency control according to FIG. 2 with only a few electronic components.

FIG. 3 shows only one of various possible embodiments for creating the desired frequency dependence. Other such circuits are well known to persons skilled in this art.

Figure 4:
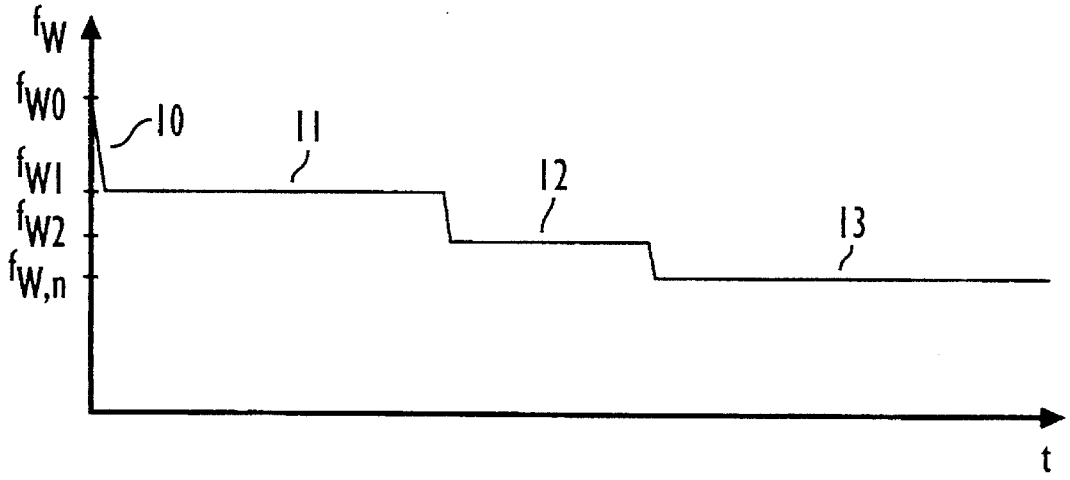
FIG. 4 is a qualitative illustration of the inverter frequency $f_W$ as a function of time during the start-up phase of the ballast.

So far, the discussion has been confined to the control of the inverter frequency after ignition of the lamp. FIG. 4 illustrates schematically the time dependence t of the inverter frequency $f_W$ during a start-up phase of the ballast. As it can be seen, the highest inverter frequency (starting frequency) $f_{W0}$ is used right after switching on the ballast at the left end of the diagram. This starting frequency $f_{W0}$ lies in the range of 80–100 kHz, preferably 80 kHz. This high frequency assures that the lamp voltage is low after switching on, such that undesired current bursts in the cold lamp are avoided.

This frequency is, however, immediately decreased continuously to a value of approximately 50 kHz at the end of the initial phase 10. Initial phase 10 has a duration of approximately 50 microseconds.

Initial phase 10 is followed by a pre-heating phase 11. In this phase the value of the inverter frequency lies around a value $f_{W1}$ of approximately 50 kHz and is regulated such that a desired pre-heating current $I_{VH}$ is maintained in the lamp circuit. This pre-heating phase typically lasts for about 1.2 seconds.

Then the striking phase 12 begins. In this phase the inverter frequency is lowered and regulated such that a desired ignition current $I_Z$ is maintained in the lamp circuit. The value of ignition current $I_Z$ is approximately three times the value of pre-heating current $I_{VH}$, which leads to a reduction of the inverter frequency to a range $f_{W2}$ typically around 45 kHz. The resulting increase of the lamp voltage causes a normally operative lamp to strike or ignite within a very short time period.

As soon as a striking of the lamp has been detected, the ballast enters its normal working phase 13. The inverter frequency $f_{W,n}$ is now around 35 kHz and is set in dependence of the rectified voltage $U_{ZK}$, as illustrated in FIG. 2. (The frequency modulation of the inverter frequency $f_W$ in the normal working phase 13 is not shown in FIG. 4.)

FIG. 4 depicts a situation, where lamp La did not strike immediately. In this case, striking phase 12 is maintained up to about 0.8 seconds. If no striking of the lamp is detected after this time, the start-up phase is aborted.

Control circuit 4 monitors the whole start-up phase and assures that the inverter frequency $f_W$ never falls below a minimum frequency $f_{W,min}$, which depends directly on the rectified voltage $U_{ZK}$. This minimum frequency is generated by the circuit of FIG. 3 and therefore corresponds to the curve of $f_{W,n}$, shown in FIG. 2 in normal operation of the ballast.

Figure 5:
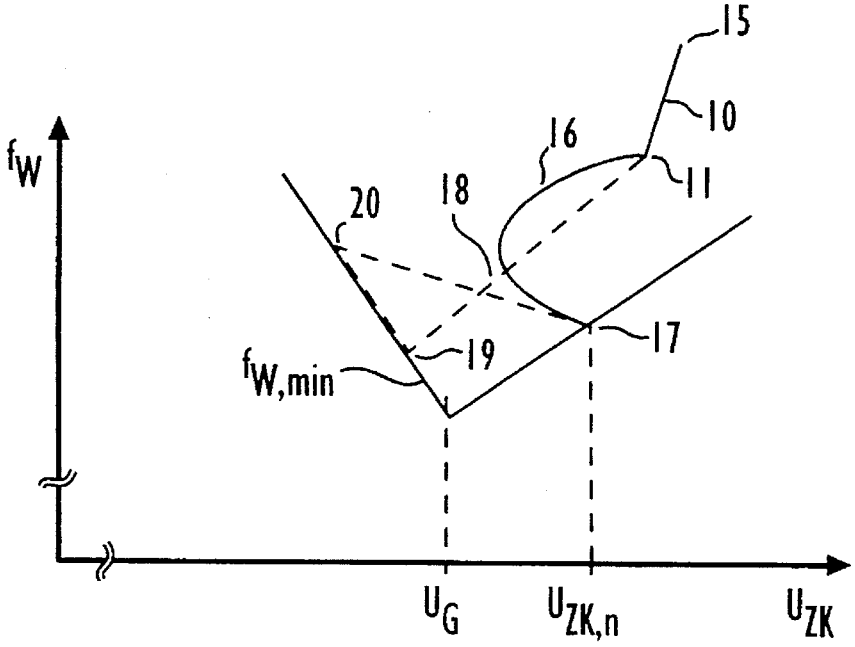
FIG. 5 is a qualitative illustration of the inverter frequency $f_W$ of the ballast during start-up in relation to the rectified voltage $U_{ZK}$.

This is further illustrated in FIG. 5, which shows the change of the inverter frequency $f_W$ and the rectified voltage $U_{ZK}$, during the start-up phase. During this start-up phase, the rectified voltage $U_{ZK}$ is not constant because the current drawn from rectifier 1 varies considerably.

The start-up phase begins at a point 15 with the high starting frequency $f_{W0}$ and high rectified voltage $U_{ZK}$. Upon lowering of the frequency, during the initial phase 10, the current drawn from rectifier 1 is increased and the rectified voltage becomes smaller. At point 11 the pre-heating frequency $f_{W1}$ is reached.

After expiration of the pre-heating time, the frequency is decreased further. The path in the diagram of FIG. 5, during ignition, depends considerably on the quality of lamp La. A satisfactory new lamp approximately follows path 16 by shortly drawing an increased current when it strikes and then proceeding to the normal point of operation 17, where the frequency is set as a function of the rectified voltage as shown in FIG. 2.

Other lamps can, however, draw an even higher current without striking. This leads to the problem that the rectified voltage $U_{ZK}$ falls to a very low value, which, in turn, leads to a further decrease of the inverter frequency $f_W$. To stop this process, control circuit 4 ensures that during the whole start-up phase the inverter frequency $f_W$ does not fall below the minimum frequency $f_{W,min}$. If a lamp therefore follows path 18, the inverter frequency will reach a minimum at point 19. Then, it is automatically increased to point 20. Here the circuit remains until the lamp strikes and then goes over to the normal point of operation 17.

The start-up phase illustrated in FIG. 5 therefore suppresses excess current peaks when the ballast is switched on. Furthermore, it avoids that the current drawn from rectifier 1 becomes too high and the inverter frequency too low. Since the curve of the minimum frequency $f_{W,min}$ is identical to the curve of the inverter frequency during normal operation according to FIG. 2, both curves can be generated by the same circuitry. This simplifies the design of the ballast and the transition between the start-up phase and normal operation.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A method for operating a ballast for discharge lamps, wherein said ballast comprises a line-voltage rectifier for generating a rectified voltage and an inverter, fed by said rectified voltage, for generating an AC voltage with an inverter frequency, in combination with a lamp in a lamp circuit driven by said AC voltage, wherein said method, during normal operation of said lamp, comprising choosing said inverter frequency as a function of said rectified voltage.

2. The method of claim 1 further including, in a normal voltage range of said rectified voltage, linearly decreasing said inverter frequency with decreasing rectified voltage.

3. The method of claim 2 further including, in a low voltage range below said normal voltage range, linearly increasing said inverter frequency with decreasing rectified voltage.

4. The method of claim 3 with the derivative of said inverter frequency, with respect to said rectified voltage, fulfilling:

$$(df_W/dU_{ZK})|_u=-k(df_W/dU_{ZK})|_n$$

wherein $(df_W/dU_{ZK})|_u$ is the derivative of said inverter frequency $f_W$ in respect to said AC voltage $U_{ZK}$ in said low voltage range, wherein $(df_W/dU_{ZK})|_n$ is the derivative of said inverter frequency $f_W$ with respect to said AC voltage $U_{ZK}$ in said normal voltage range, and k is a constant between 2 and 2.5.

5. The method of claim 1 further including, during a start-up phase for causing said lamp to strike, varying said inverter frequency but preventing said inverter frequency from falling below a minimum frequency, and choosing said minimum frequency as a function of said rectified voltage.

6. The method of claim 5 further including, in a normal voltage range of said rectified voltage, decreasing said minimum frequency with said rectified voltage decreasing, and in a low voltage range of said rectified voltage, increasing said minimum frequency with said rectified voltage decreasing.

7. The method of claim 5 further including, keeping said minimum voltage, as a function of said rectified voltage during said start-up phase, substantially equal to said inverter frequency as a function of said rectified voltage during said normal operation of said lamp.

8. The method of claim 5 further including, during at least part of said start-up phase, choosing said inverter frequency as a function of a current in said lamp circuit while said inverter frequency is above said minimum frequency.

9. The method of claim 5 further including, during said start-up phase, bringing said inverter frequency, in a first step upon switching-on of said ballast, to a first frequency range;

bringing said inverter frequency, in a second step for pre-heating said lamp, to a second frequency range;

bringing said inverter frequency, in a third step for striking said lamp, to a third frequency range; and bringing said lamp frequency, after the striking of said lamp, into a normal range, with said first frequency range being higher than said second and third frequency ranges and higher than said normal frequency range.

10. The method of claim 9 further including, in said second step, determining a current in said lamp circuit and regulating said inverter frequency to make said current equal to a given lamp heating current.

11. The method of claim 9 further including, in said third step, determining a current in said lamp circuit and regulating said inverter frequency to make said current equal to a given ignition current.

12. The method of claim 10 further including, in said third step, regulating said inverter frequency to make said current equal to a given ignition current, with said ignition current being larger than said heating current.

13. The method of claim 9 further including, in said first step, continuously decreasing said inverter frequency in time.

14. The method of claim 1 further including, producing a ripple in said rectified voltage via said line voltage and frequency-modulating said inverter frequency via said ripple.

15. The method of claim 14 wherein the amplitude of said ripple is at least 10% of said rectified voltage.

* * * * *